United States Patent [19]

Shephard

[11] 4,359,629

[45] Nov. 16, 1982

[54] TACTICAL INDICATOR FOR BULKHEAD AND OTHER COMPASSES

[75] Inventor: Kevin E. Shephard, Wollstonecraft, Australia

[73] Assignee: J & K Shepard Pty. Limited, Wollstonecraft, Australia

[21] Appl. No.: 166,886

[22] Filed: Jul. 8, 1980

[51] Int. Cl.[3] ..... G06G 1/08

[52] U.S. Cl. ..... 235/78 N; 235/88 N

[58] Field of Search ..... 235/78 N, 88 N, 116

[56] References Cited

U.S. PATENT DOCUMENTS 3,721,007 3/1973 Banner ..... 235/78 N

*Primary Examiner*—L. T. Hix

*Assistant Examiner*—Thomas H. Tarcza

*Attorney, Agent, or Firm*—Ladas & Parry

[57] ABSTRACT

Yacht racing is becoming more scientific and to assist a skipper in quantifying the shortest course to sail to take advantage of wind direction, a tactical aid is provided. The aid is a device for use in connection with information read from a compass mounted on the yacht.

The device comprises a set of interacting members each carrying information concerning a yacht's tactical position to enable the skipper to determine whether or not his course is advantageous or not.

3 Claims, 2 Drawing Figures

TACTICAL INDICATOR FOR BULKHEAD AND OTHER COMPASSES

This invention relates to apparatus for use with bulkhead and other compasses, particularly for use on racing yachts.

The main use of a compass on a racing yacht when sailing, particularly in a predefined area around marker buoys, is to determine the angle of the wind to the various angles of the legs of the course. Once the angle of the wind to the leg of the course has been determined a number of parameters to enable the racing yacht to pass around the course in the fastest possible time can be determined.

The information required to enable the fastest course to be sailed by the yacht is the following:

the angle of the starting line to the wind and which end is favoured; the angle through which the yacht tacks; whether the wind is shifting and if so whether it is favourable or unfavourable when beating to windward; the course to steer to each mark of an Olympic course which marks are always positioned at fixed angles to the wind direction; when gybing downwind to increase speed the crew need to know if the wind is shifting, and if it is a favourable shift or not.

A normal magnetic compass can be used to provide this information by taking readings from the compass and performing a series of calculations to derive the answers required above. However, in a racing yacht situation, particularly where there is no person on board the yacht whose duties are purely navigational, it is not realistically possible for the skipper or crew to perform these calculations, which must be continually updated to compensate for wind changes.

It is the object of the present invention to reduce the calculation required by providing the information in a readily readable form.

In one broad form the invention provides an apparatus for converting compass readings to yacht performance readings comprising a compass ring having markings from 0° to 360° thereon and an information ring concentric with said compass ring, said compass ring being adapted to be rotatably adjusted with respect to said compass ring, said information ring having marks thereon at the various positions required to determine various yachting information.

Figure 1:
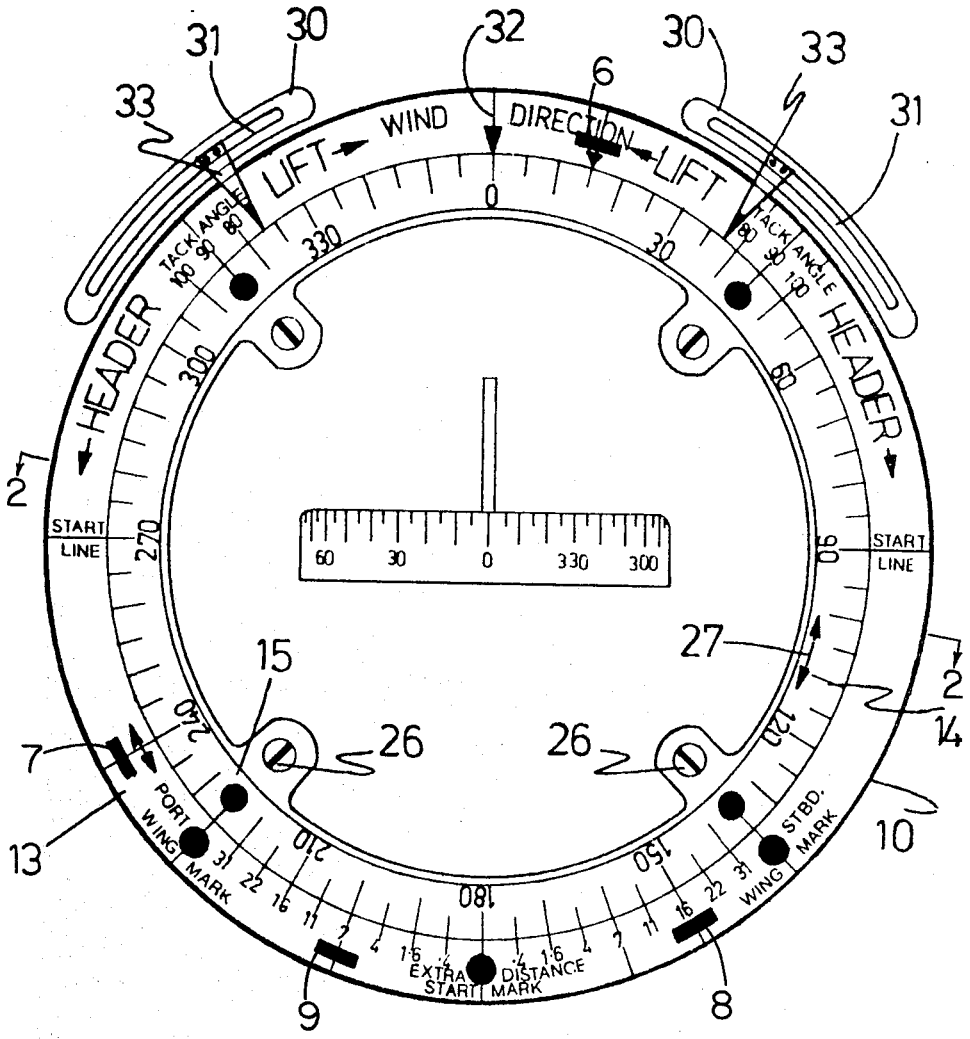
Figure 2:
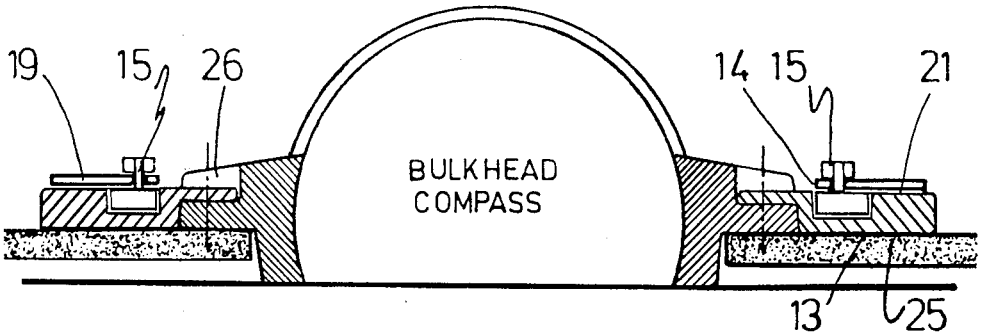

The invention will now be described by way of example only with reference to the accompanying drawings, wherein:

FIG. 1 is an elevational view of the preferred apparatus of the invention mounted around a bulkhead compass; and FIG. 2 is a sectional view taken on the line 2—2 of FIG. 1.

Compasses as used in sailing boats are generally mounted on a vertical bulkhead or in a cavity in a deck. The most accurate compasses comprise a floating magnetic card mounted in a glass, spherical, liquid filled container, thus the card is always horizontal.

The device in accordance with the invention is preferably designed to be mounted around the outside of the compass for no other reason than for ready reference to the compass. There is, however, no mechanical interrelationship between the compass and the apparatus. When the compass is mounted on a horizontal deck, the centre line of the boat can be used to line up the reading on the compass card with a pre-required setting for the information of the device.

The device of the invention basically comprises two concentric members 13 and 14. The first member 13, which is fixedly mounted to the hull by means of fasteners 26, will be referred to as the information indicator member. The second member 14 is rotatably mounted in a cavity 20 of the indicator member 13. The second member has markings around its circumference from 0 to 360 which refer to the degrees of the compass. Mounted on the second member 14 is a transparent plastics member 19. The transparent plastics member 19 is concentric with the first member 13 and is rotatably mounted with respect to the first and second members 13 and 14. The rotatable mounting is achieved by locating the member 19 above the second member 14 and is clampable thereto by means of thumb screws 15. Thus the member 19 can be rotated about its centre relative to the first and/or the second member, or when clamped to the second member 14 can be rotated therewith relative to the first member 13.

The information surface 21 of the first member 13 has a number of features which provide the information required by the tactician on a racing yacht to convert compass information to tactical information without the need for mathematical calculations.

The course for yacht racing basically comprises a starting line which is set at 90° to the wind direction. The first mark of the course is set to windward of the starting line, at right angles thereto, and some distance to windward. Thus, if the starting line is set perfectly at right angles to the wind direction the arrow 32 will indicate the direction of the first mark of the course to the starting line as well as the wind direction.

As yachts tack to windward they will tack at an angle of approximately 45° to the true wind. If a yacht sails at an angle of more than 45° to the general wind direction, the wind has shifted slightly and should tack on to its other leg. Thus the indicator 21 has a portion spanning 90°, 45° either side of the wind direction indicator 32, marked "lift" and 2 sections from 45° to 90° on the left and righthand sides of the wind direction arrow outside the central 90° area, marked "header." Thus, if the reading on the compass corresponds with the reading on the area marked "header" then the yacht should tack on to its other leg. At 180° to the wind direction arrow 32 are marked 2 positions start line. Most yacht courses have a wing rounding mark on the starboard or port side of the course at 135° to the windward mark. These 2 wing marks being port and starboard are marked on the indicator face 21, the port mark being red and the starboard mark being green. Between the 2 wing mark areas there is a centrally positioned black marked "start mark" at 180°. In the region of the black start mark is a scale setting forth the percentage of extra distance travelled by deviating from the straight return from the windward mark to the leeward mark, i.e. the rhumb line. It is thus possible to determine how much extra distance the boat will travel. If the rhumb line is not followed the increase in speed must exceed the extra distance travelled.

The transparent member 19 comprises 4 markings only, these 4 markings corresponding to the arrow 32, the 2 wing markings and the start mark of the indicator 21, the use of these markings will become apparent later on.

The final part of the apparatus comprises adjustable indicators 33 which are movable along slots 31 mounted on fixed mountings 30. The use of these indicators will be apparent from the further description.

The device 10 is used in the following way:

The mean wind direction is determined and this bearing dialled upon the rotating bezel 14 until it is opposite the wind direction arrow 32. The yacht is then sailed along the start line and the compass is read. The bearing is then read on the rotating compass ring 14 and, if found opposite a start line mark, the starting line is square to the wind. If the bearing when read on the compass ring 14 appears adjacent to a red "header" section the line is favoured at that end. If adjacent to a white area the line is favoured at the opposite end. How far the bearing is away from the start line mark indicates how far the start line is off, "Square to wind." Beating to windward the bearing on each tack is referred to the ring 14 and the tacking angle can be read off. If the wind shifts favourably whilst beating to windward the compass bearing when read on the ring 14 will move further into or towards the green "lift" sector. Conversely if the wind shifts unfavourably the compass bearing will move further into or towards the red "header" sector. When sailing the reaching legs of the Olympic course, if port hand around, the course to steer to the wing mark is shown on the ring 14 opposite the red port wing mark. For the second reaching leg the course to steer for the start mark is shown opposite the green starboard wing mark. When sailing the downwind leg of the Olympic course the course to steer is indicated on the ring 14 opposite the black start mark. If gybing downwind to increase speed the course being steered on the compass is read off the ring 14 and the required percentage speed increase to break even is read off the percentage extra distance scale. When sailing downwind at a constant angle to the wind consider gybing if the compass heading when read on the ring 14 moves out of or further away from the red zone at the black start mark.

The clear plastics ring 19 duplicates certain of the markings on the information surface 21 outer ring 13. They are: arrow with bar 6 at 0°; a red bar 7 at 225°; a green bar 8 at 135°; a black bar 9 at 180°. It will be appreciated that the clear ring 19 is shown in FIG. 1 with its markings displaced through 15° from the corresponding markings on the information surface 21. The purpose of this clear ring 19 and markings are to take into account the fact that:

The wind may make a permanent shift after the course has been laid.

The course may not be laid directly into the wind, rendering the marks in the outer ring 13 incorrect.

The clear ring is used in the following way:

(a) if the bearing of the first mark is signalled from the committee boat the thumb screws 15 are loosened and the clear ring 19 turned till the arrow 6 points to the bearing signalled and the thumb screws 15 tightened.

(b) the wind bearing is then taken and the rotatable ring 14 turned until this bearing is opposite the wind direction arrow on the outer ring.

It will then be clear if the course is laid dead to windward and if not the following will be immediately apparent: which side of the course is favoured; the corrected courses to the wing-mark and start mark; which side the spinnaker will be carried on the downwind leg.

If the wind swings permanently whilst the race is in progress the rotatable ring 14 can be reset to the new wind direction without upsetting the course to the marks indication.

If the committee reset the course after a major windshift repeat the procedure in (a) above.

The two adjustable pointers 33, marked port and starboard, can be positioned over the tack angle scale to indicate the mean bearing on each tack.

The purpose of these pointers 33 is to remind the helmsman of the mean heading on each tack establish the mean tacking angle. If a permanent wind shift occurs whilst going to windward after the indicator has been set and the tacking angle is known and the pointers aligned, the indicator can be reset by rotating the ring 14 until the new heading on port or starboard tack is opposite the appropriate pointer. This will now result in the new wind direction being established.

The pointers 33 may, however, be subdivided into pairs of pointers (not shown). This will allow the pointers to be first set to one position and then if there is a further wind change, the second pointer of each pair of pointers may be further adjusted to note the new wind change whilst maintaining the old tacking angle if the wind swings back.

What I claim is:

1. A device adapted for use with a compass for tactical yacht racing comprising a compass ring having suitable 0° to 360° markings thereon around the ring; and an information ring having markings of at least "wind direction," "tack angle" at 45° on either side of "wind direction;" "start line" at 90° on either side of "wind direction;" "wing mark" at 135° on either side of "wind direction;" said compass ring being rotatable with respect to said information ring, and the device further comprising releasable means for locking the compass ring against rotation with respect to the information ring, and a correction factor ring rotatable with respect to the other rings and releasably attached to the compass ring, said correction factor ring having distinctive markings at least at the positions 0°, 135°, 225° and 180°.

2. The device of claim 1, wherein an adjustable pointer means is provided for releasable engagement relative to the area 30° to 60° on either side of the "wind direction" marking.

3. The device of claim 1 or 2, being generally annular in form and mounted around a compass.

* * * * *

UNITED STATES PATENT AND TRADEMARK OFFICE

CERTIFICATE OF CORRECTION

PATENT NO. : 4,359,629

DATED : November 16, 1982

INVENTOR(S) : Kevin E. Shephard

It is certified that error appears in the above-identified patent and that said Letters Patent is hereby corrected as shown below:

On the title page, the assignee should read:

-- J & K Shephard Pty. Limited --.

Signed and Sealed this

*Fifteenth* Day of *April 1986*

[SEAL]

*Attest:*

DONALD J. QUIGG

*Attesting Officer*

*Commissioner of Patents and Trademarks*